US006135809A

United States Patent [19]

Asakawa

[11] Patent Number: 6,135,809

[45] **Date of Patent: *Oct. 24, 2000**

[54] CARD CONNECTOR

[75] Inventor: Kazushige Asakawa, Kanagawa, Japan

[73] Assignee: The Whitaker Corporation, Wilmington, Del.

[ * ] Notice: This patent issued on a continued prosecution application filed under 37 CFR 1.53(d), and is subject to the twenty year patent term provisions of 35 U.S.C. 154(a)(2).

[21] Appl. No.: 09/113,272

[22] Filed: Jul. 10, 1998

[30] Foreign Application Priority Data

Jul. 11, 1997 [JP] Japan ..... 9-202480

[51] Int. Cl.[7] ..... H01R 13/71

[52] U.S. Cl. ..... 439/489; 439/188; 439/260

[58] Field of Search ..... 439/266, 630–637, 439/489, 188

[56] References Cited

U.S. PATENT DOCUMENTS

| | | | |
|---|---|---|---|
| 4,735,578 | 4/1988 | Reichardt et al. | 439/152 |
| 4,900,272 | 2/1990 | Lange et al. | 439/630 |
| 4,900,273 | 2/1990 | Pernet | 439/188 |
| 5,013,255 | 5/1991 | Juret et al. | 439/260 |
| 5,330,363 | 7/1994 | Gardner et al. | 439/188 |
| 5,334,034 | 8/1994 | Reichardt et al. | 439/188 |
| 5,334,827 | 8/1994 | Bieier et al. | 235/492 |
| 5,511,986 | 4/1996 | Casey et al. | 439/188 |
| 5,667,397 | 9/1997 | Broschard, III et al. | 439/188 |
| 5,674,085 | 10/1997 | Davis et al. | 439/188 |
| 5,718,609 | 2/1998 | Braun et al. | 439/630 |

FOREIGN PATENT DOCUMENTS 2615161 5/1997 Japan .

OTHER PUBLICATIONS

Abstract and drawings for File No. 16909, Serial No. 09/106,437 filed Jun. 29, 1998, based on Provisional Application Serial No. 60/051,322 filed Jun. 30, 1997.

*Primary Examiner*—Hien Vu

[57] ABSTRACT

A card connector includes a detecting unit indicating the full insertion of a card into a card-receiving slot that provides no pressure on the card in the direction of its ejection, thereby providing for better reliability of electrical connections between the connector and the card. Card (C) is inserted in card-receiving slot (4) of housing (2) of card connector (1). When the card (C) is fully inserted in the card-receiving slot, one side of the card presses down V-shaped contact section **(52*a*) of sensing member (52) breaking its electrical contact with sensing member (54), thus confirming the full insertion of the card into the card-receiving slot. The V-shaped contact section (52*a*)** exerts pressure against the card (C) in a perpendicular direction.

4 Claims, 4 Drawing Sheets

CARD CONNECTOR

FIELD OF THE INVENTION

The present invention relates to card connectors, especially to card connectors having a detecting or sensing unit of full insertion of a card into a card-receiving slot.

BACKGROUND OF THE INVENTION

Smart cards having a built-in IC are used as banking cards or in terminals of satellite telecommunications systems. In order to read information stored on the IC of these cards, card connectors are known, such as, for example, a chip-card connector described in U.S. Pat. No. 5,334,827. Such a connector 100 shown in FIG. 7 has a set of sensors 104, 104' of identical configuration. At the upper part of the sensor 104, an arm 108 is provided which extends sidewise under a bottom surface of arm 108' of the sensor 104' with which it forms a normally-closed circuit. When a card (not shown) is inserted in slot 106, its front edge pushes upwardly slanted surface 110' of the arm 108' of the sensor 104'. As a result, the engagement between arms 108, 108' is broken, the circuit is open, thereby indicating that the card is fully inserted.

Japanese Patent No. 2,615,161 describes a detecting device comprising two contact blades together forming a normally-closed detecting circuit; one of the blades can move in the direction of the card insertion and the other one is fixed.

Since in the conventional card connector 100, the slanted surface 110' of the arm 108' is pushed upwards by the card, a clockwise torque is applied to arm 108'. When the card is fully inserted, a front edge of the card is located just under a flat section 109' of the arm 108'. However, due to vibration or other mechanical action, the front edge of the card can be displaced under slanted surface 110'. As a result, the spring-loaded action of the arm 108' will push the card in the direction of ejection, that is to the right side of FIG. 7, thus reducing reliability of the electrical connections of the card. If a card is thick, there is a danger that its front edge can engage against end 108'*a* of the arm 108' and deform it.

In the second example disclosed in the Japanese Patent, pressure from the movable blade is always applied to the inserted card in the direction of ejection which also can adversely affect the reliability of the electrical connections.

The purpose of the present invention is to provide a card connector free of the above-mentioned disadvantages which would include a detecting or sensing unit exerting no force ejecting a card after it has been fully inserted into the connector and providing reliable electrical connections between the card and the connector.

The other purpose of this invention is to provide a card connector that prevents deformation of the detecting unit at the time of card insertion into the connector.

SUMMARY OF THE INVENTION

A card connector according to the present invention comprises electrical contacts forming electrical connections with a memory card inserted therein and a detecting or sensing unit including a set of sensing members connected to a detecting circuit indicating the state when the card is fully inserted into the connector, and one of the sensing members has a bend that exerts pressure on one surface of the card in a perpendicular direction relative to the one surface and closes or opens the detecting circuit.

The card connector according to the present invention comprises electrical contacts forming electrical connections with a card inserted into a card-receiving slot, and a detecting or sensing unit comprising a set of sensing members connected to a detecting circuit indicating a state when the card is fully inserted into the connector, and that the sensing members have free ends that mutually form and break electrical connection upon insertion of the card with the free ends being covered by a wall of the card-receiving slot.

It is desirable that the housing having the card-receiving slot into which the card is inserted is formed as a single unit.

A card connector comprises a housing having a card-receiving slot for receiving a card therein, electrical contacts on the housing and having contact members extending into the card-receiving slot for electrical engagement with the card, and a detecting unit on the housing adjacent the electrical contacts including sensing members one of which has a bent section extending into the card-receiving slot for engagement by the card when inserted into the card-receiving slot thereby causing the sensing members to operate a detecting circuit indicating complete insertion of the card in the card-receiving slot, wherein the bent section is in the form of an arcuate section.

BRIEF DESCRIPTION OF THE DRAWINGS

Embodiments of the present invention will now be described by way of example with reference to the accompanying drawings in which:

FIG. 5B showing the connector in the process of insertion of the card therein; FIG. 5C showing the card fully inserted into the connector.

DETAILED DESCRIPTION OF THE INVENTION

Figure 1:
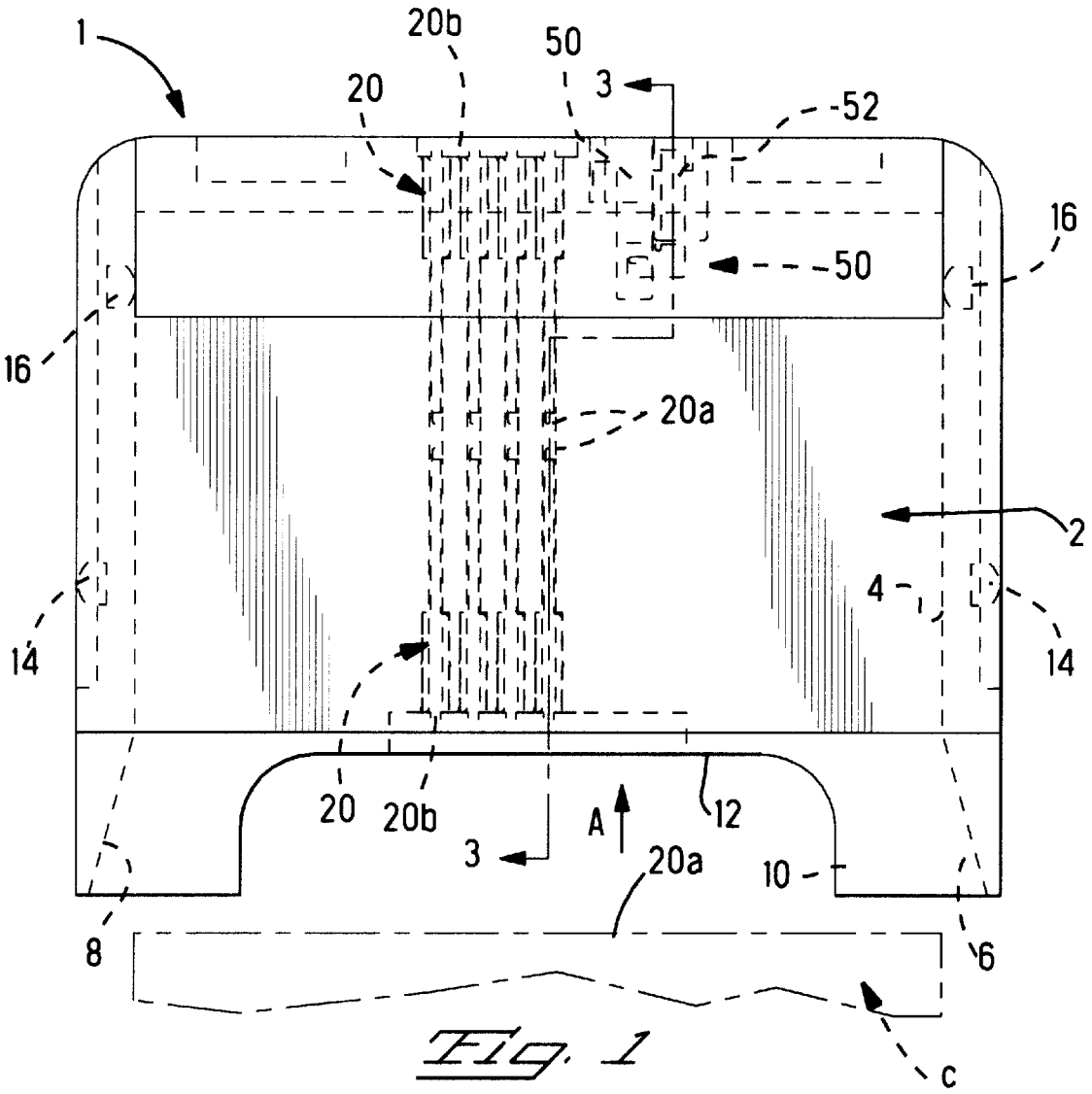
FIG. 1 is a top plan view of a card connector according to the present invention.

In FIG. 1, insulating housing 2 has a card-receiving slot 4 for accepting a card C. The card-receiving slot 4 has an opening 6 shown in the lower part of FIG. 1. In the vicinity of the opening 6, the slot 4 has slanted walls 8 flaring to the outside for the purpose of guiding the card C during its insertion into the card-receiving slot. A cutout 12 is made in the housing 2 at the card-insertion opening 10 for the purpose of saving material. Thickness of the card C is set to 0.76 mm.

At a bottom or inner end of the housing 2, eight electrical contacts 20 are arranged in two groups of four contacts facing each other. Each contact 20 includes a mounting section 20*b*, which is secured in the housing 20, and a free end 20*a*. Near the free end 20*a*, a V-shaped contact member 20*c* (see FIG. 3) is located, the purpose of which is to form electrical connection with contact pads of the card C (not shown). A detecting unit or device 50 detecting that the card C is fully inserted is located adjacent an inner end of housing 2. Explanations regarding the detecting unit 50 are given below. Mounting legs 14, 16 are integral with the housing 2.

Figure 2:
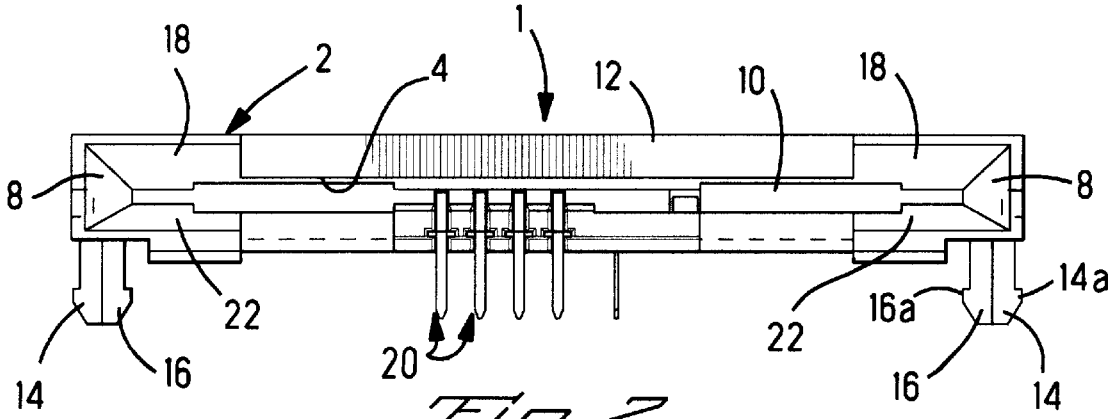
FIG. 2 is a front view along arrow A of the card connector shown in FIG. 1.

As can be seen from FIG. 2, the mounting legs 14, 16 extend down from a bottom of housing 2. Legs 14, 16 have lugs 14*a*, 16*a* facing in opposite directions, which fit into openings provided in a circuit board (not shown) to which the connector I is mounted. The legs 14, 16 may be made as regular round posts. Upper and lower surfaces 18, 22 around the insertion opening 10 are also slanted to guide the card C during its insertion into the card-receiving slot 4.

Contacts 20 are mounted in the housing 2 from the front and from the rear by pressing the mounting sections 20*b* into grooves 24 in the housing 2. Contacts 20 are arranged in contact-receiving cavities 26 of the housing 2. Contact-receiving cavities 26 are separated by partitions 28 of the housing 2. The partitions 28 have the contact-receiving cavities at their left and right sides. Free ends 20a of contacts 20 fit under retaining shoulders 30 on the top of the partitions 28. The contacts 20 are spring-loaded by the free ends 20*a* being in engagement with bottom surfaces of the retaining shoulders 30. Contact members 20*c* of the contacts 20 protrude inside the card-receiving slot 4 and are arranged so that they form electrical connection with the contact pads of the card.

Figure 3:
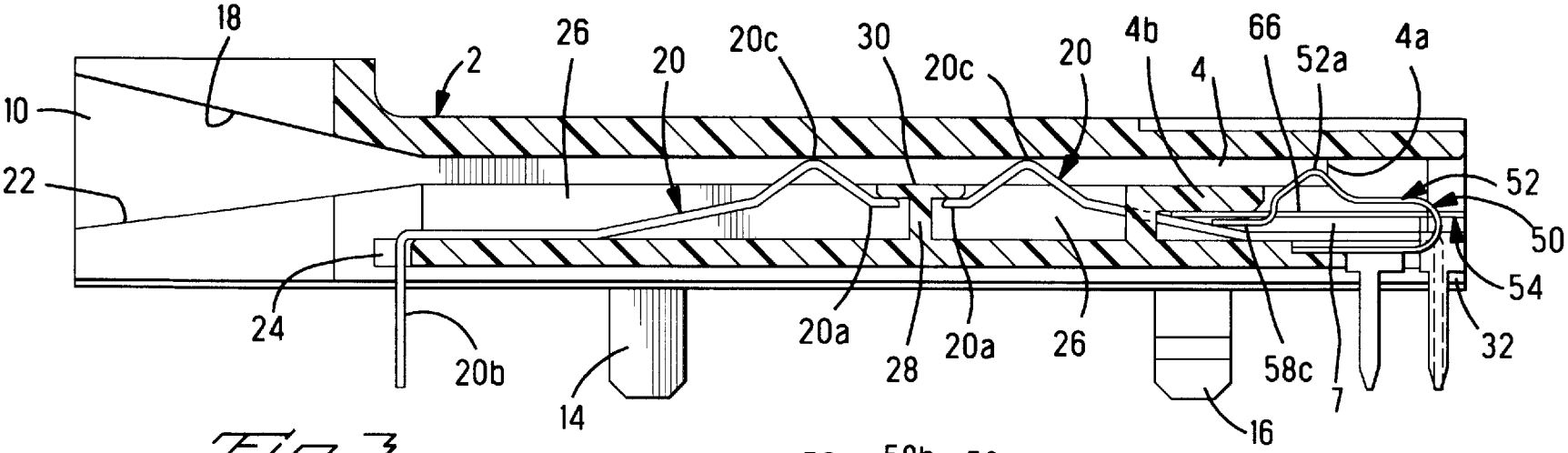
FIG. 3 is a cross-sectional view of the card connector taken along line 3—3 in FIG. 1.

Near the inner end 4*a* of the card-receiving slot 4, the detecting unit 50 is located. The detecting unit 50 has sensing members 52, 54, which are mounted in the housing 2 by pressing them through a back opening 32 (that is, in the direction from right to left as seen in FIG. 3). Bent section 52*a* in the form of a V-shaped contact section of the sensing member 52 extends inside the card-receiving slot 4 so that it engages with the inserted card C (not shown). Free ends of sensing members 52, 54, that is the connecting section 58*c* of the sensing member 52 and the contact portion 66 of the sensing member 54 (see FIG. 4) are in engagement with each other and fit into the cavity 7 provided in the partition 4*b* of the card-receiving slot 4. In this embodiment, the connecting section 58*c* exerts pressure on the contact portion 66.

Figure 4:
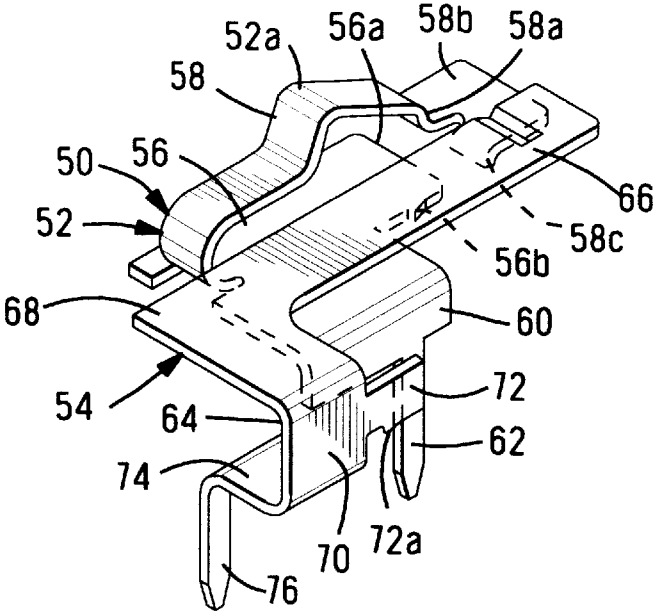
FIG. 4 is a perspective view of a detecting device or unit.

As shown in FIG. 4, the sensing member 52 includes a flat base section 56 that is pressed in the housing 2, a spring-loaded arm 58 formed by bending the base section upward near a rear end thereof and extending it forward beyond a front end 56*a* of the base section 56, an extension 60 formed by bending the side edge of the base section 56 so that it extends sidewise and down, and a post 62 extending vertically downward from the extension 60. Near front end 56*a* of the base section 56, a barb 56*b* is provided, the purpose of which is to secure the base section 56 in the housing 2. The spring-loaded arm 58 has a V-shaped contact section 52*a* facing upward located near its midpoint and a step 58*a* located forward of the contact section 52*a* followed by a flat section 58*b*. Connecting section 58*c* extends sidewise of the flat section 58*b*.

The sensing member 54 has a generally C-shaped base portion 64 a contact portion 66 extending forward from an upper leg 68 of the base portion, a lug 72 extending forward from a connecting leg 70 of the base portion 64 and a post 76 extending vertically downward from a lower leg 74. The lug 72 has a barb 72*a*, the purpose of which is to secure the sensing member 54 in the housing 2. As can be seen from FIGS. 1 and 4, sensing members 52, 54 are arranged in such a manner that the connecting section 58*c* and contact portion 66 lie one on top of other. In normal position, the connecting section 58*c* applies upward pressure on the contact portion 66, thus forming a normally-closed circuit.

Figure 5A:
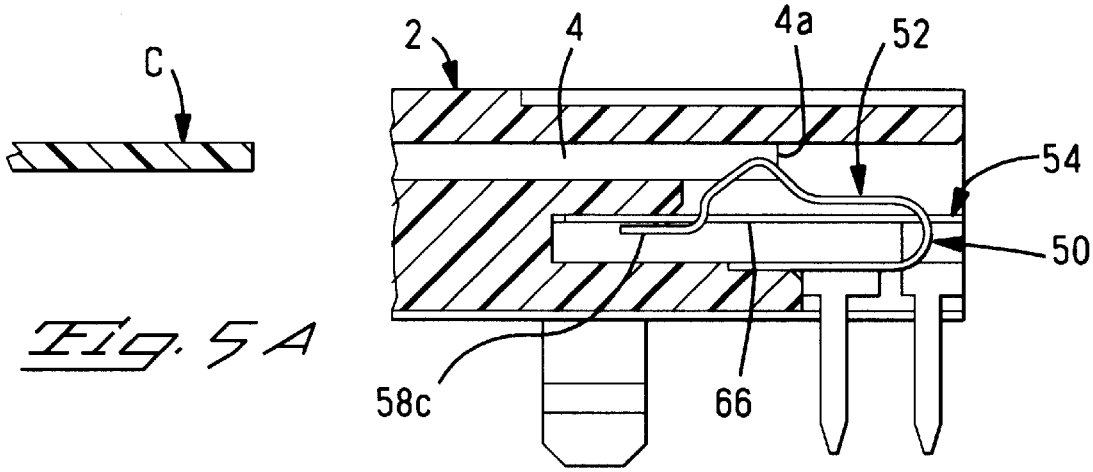
FIGS. 5A–5C are cross-sectional views of connector portions adjacent to the detecting unit with FIG. 5A showing the connector before insertion of a card into the connector.
Figure 5B:
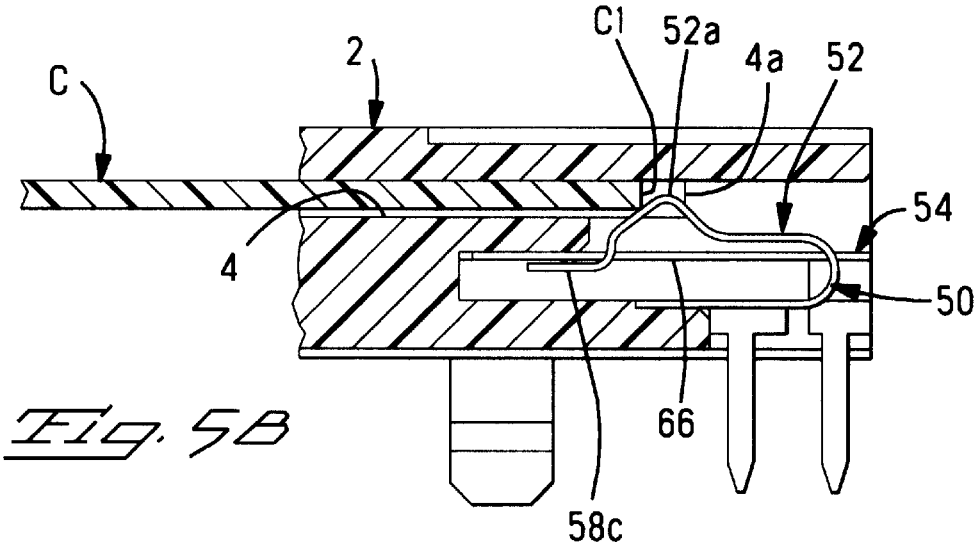
Figure 5C:
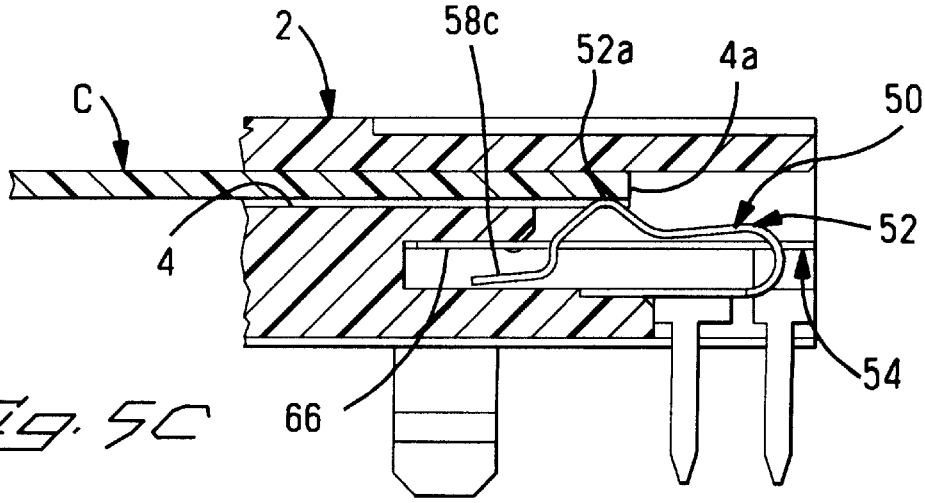

Next, explanations concerning the relationship between sensing members 52, 54 and the card C using FIGS. 5A–5C for reference are provided.

From FIG. 5A, it can be seen that before the card C is inserted into the card-receiving slot 4, the connecting section 58*c* of the sensing member 52 and contact portion 66 of the sensing member 54 are in engagement with each other. In the state shown in FIG. 5B, front edge C1 of the card C engages with a forward slanted section of the V-shaped contact section 52*a* of the sensing member 52. In this position, the connecting section 58*c* and contact portion 66 are still in engagement with each other. In the position shown in FIG. 5C, the card C is inserted farther into the card-receiving slot 4 and it starts to deflect the V-shaped contact section 52*a* down until the card reaches the end 4*a* of the card-receiving slot 4, thus completing the insertion process. Since the V-shaped contact section 52*a* is deflected down, the connecting section 58*c* separates from the contact portion 66, thus opening the circuit and indicating that the card C is fully inserted into the card-receiving slot 4. In this position, the V-shaped contact section 52*a* applies pressure on a contact pad (not shown) of the card C vertically from underneath, thereby not creating a force pushing the card C out of the card-receiving slot 4. While the V-shaped contact section 52*a* is in engagement with the contact pad, no additional ejecting force is created even when the mutual position of the V-shaped contact section and the contact pad is shifted, thus assuring high reliability of the electrical connection therebetween.

Figure 6:
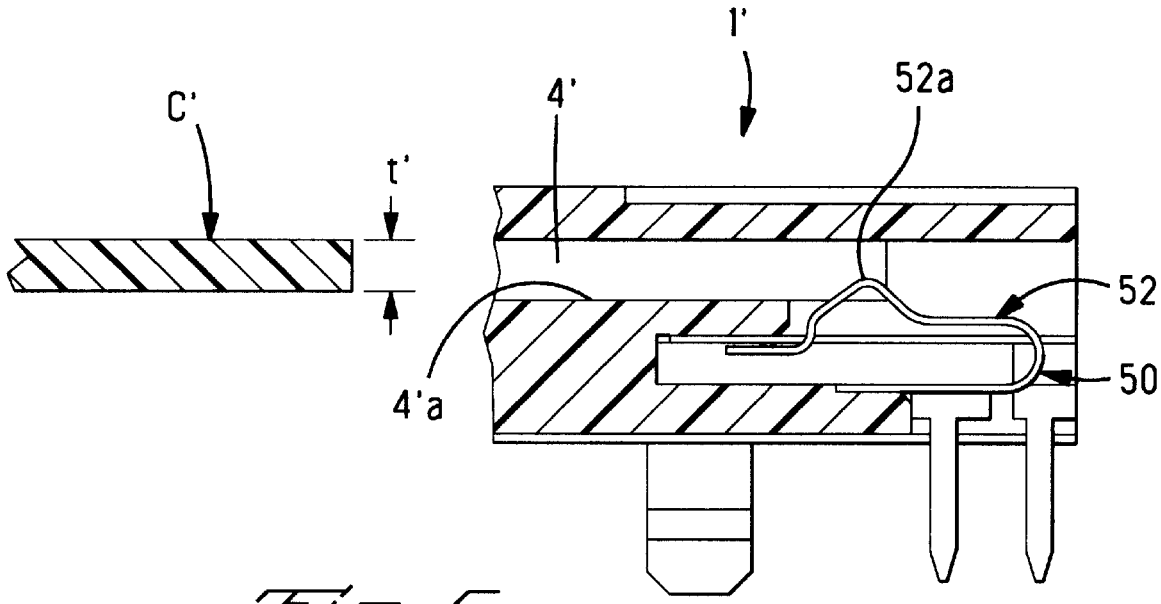
FIG. 6 is a cross-sectional view of an alternative embodiment of the card connector.
Figure 7:
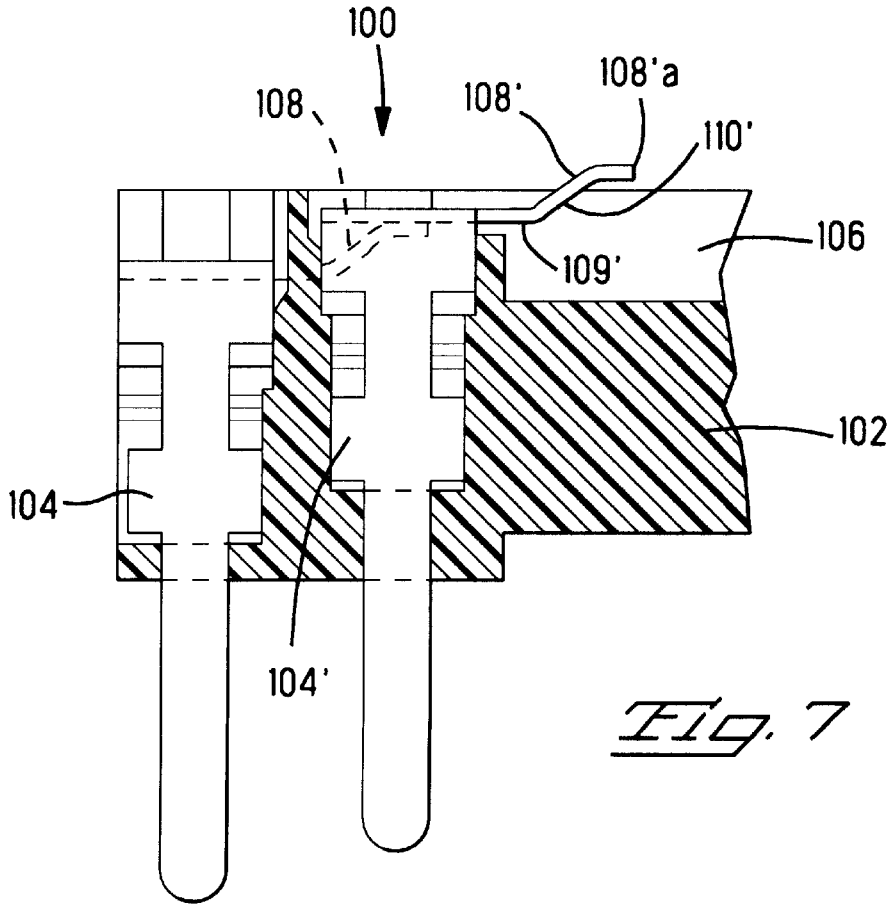
FIG. 7 is a part cross-sectional view of a conventional card connector.

An alternative embodiment of the card connector intended for cards C' whose thickness is greater than that of the card C is shown in FIG. 6. Assume that the thickness t' of card C' is 1.4 mm. A card-receiving slot 4' for cards C' must be wide enough to accommodate cards C' having thickness t'. However, the portion of the V-shaped contact section 52*a* of the sensing member 52 extending inside the card-receiving slot 4' above a bottom surface 4'*a* must remain the same as in the previous embodiment.

Therefore, when the card C' is inserted, the V-shaped contact section 52*a* is depressed downward and detection of the full insertion of the card C' is possible. The advantage of this embodiment is that no need is required to change sensing members 52, 54, and the sensing member 52 does not prevent the card C' from being inserted into the card-receiving slot 4'.

Explanations concerning embodiments of the present invention have been provided. However, the invention is not limited to these embodiments only but also covers various changes and modifications thereof.

For example, the detecting unit 50 described herein contains a normally-closed circuit, but it may be also a normally-open type. In such a case, the connecting section 58*c* and the contact portion 66 must engage one another when the card C is fully inserted into the card-receiving slot.

The card connector according to the present invention has a unit detecting the state of full insertion of a card into a card-receiving slot one part of which has a V-shaped contact section that applies pressure perpendicularly to one side of the card, thereby providing for the following effect. After the card is fully inserted, the detecting unit does not exert pressure on the card in the direction of ejection even in a case when the card is slightly off its normal position, thus enhancing reliability of electrical connections between the connector and the card.

In the card connector, free ends of contact elements of the detecting unit are covered by a wall of the card-receiving slot for the card insertion, thereby resulting in the elimination of a danger that contact elements of the detecting unit can be deformed by the card, thus providing for a higher reliability of electrical connections between the connector and the card.

What is claimed is:

1. A card connector, comprising a housing having a card-receiving slot for receiving a card therein;

electrical contacts in the housing including contact members extending into the card-receiving slot for electrical engagement with the card;

a detecting unit in the housing including sensing members mounted side-by-side in the housing;

one of the sensing members having a contact portion that is spaced below the card-receiving slot; and another of the sensing members including a base section having a front end and a rear end, a spring-loaded arm that extends upwardly from the rear end and forwardly beyond the front end of the base section, the spring-loaded arm including an arcuate section that extends into the card-receiving slot, and a connecting section that extends under the contact portion and is normally engaged with the contact portion, whereby when the card is received in the card-receiving slot, the card engages the arcuate section and deflects the spring-loaded arm, thereby disengaging the connecting section from the contact portion.

2. The card connector according to claim 1, wherein the spring-loaded arm includes a flat section that is forward of the arcuate section, and the connecting section extends sidewise from the flat section.

3. A card connector, comprising a housing having a card-receiving slot for receiving a card therein;

electrical contacts in the housing including contact members extending into the card-receiving slot for electrical engagement with the card;

a detecting unit in the housing including sensing members mounted side-by-side in the housing;

one of the sensing members having a contact portion that is spaced below the card-receiving slot; and another of the sensing members including a base section and a spring-loaded arm that extends upwardly and forwardly from a rear end of the base section, the spring-loaded arm having an arcuate section that extends into the card-receiving slot, a flat section that is forward of the arcuate section, and a connecting section that extends sidewise from the flat section to a position under the contact portion, the connecting section being normally engaged with the contact portion, whereby when the card is received in the card-receiving slot, the card engages the arcuate section and deflects the spring-loaded arm, thereby disengaging the connecting section from the contact portion.

4. The card connector according to claim 3, wherein the base includes a front end, and the spring-loaded arm extends forwardly beyond the front end of the base section.

* * * * *